United States Patent [19]

Fletcher et al.

[11] 3,971,915

[45] July 27, 1976

[54] SUN ANGLE CALCULATOR

[76] Inventors: James C. Fletcher, Administrator of the National Aeronautics and Space Administration, with respect to an invention of Anne Flippin, Friendswood; Arthur L. Schmitt, Dickinson, both of Tex.

[22] Filed: Dec. 11, 1974

[21] Appl. No.: 531,576

[52] U.S. Cl. ..... 235/61 NV; 235/88 M; 235/78 M

[51] Int. Cl.[2] ..... G06C 27/00

[58] Field of Search ..... 235/61 NV, 77, 78, 83, 235/88, 116

[56] References Cited

UNITED STATES PATENTS

| | | | |
|---|---|---|---|
| 3,290,799 | 12/1966 | Eisenhauer | 235/88 |
| 3,360,196 | 12/1967 | Grega | 235/88 |

*Primary Examiner*—L. T. Hix
*Assistant Examiner*—Vit W. Miska
*Attorney, Agent, or Firm*—Marvin J. Marnock; John R. Manning; Marvin F. Matthews

[57] ABSTRACT

Disclosed is a circular computer and system for determining the sun angle relative to the horizon from any given place and at any time. The computer includes transparent, rotatably mounted discs on both sides of the circular disc member. Printed on one side of the circular disc member are outer and inner circular sets of indicia respectively representative of site longitude and Greenwich Mean Time. Printed on an associated one of the rotatable discs is a set of indicia representative of Solar Time. Printed on the other side of the circular disc member are parallel lines representative of latitude between diametral representations of North and South poles. Elliptical lines extending between the North and South poles are proportionally disposed on the surface to scale Solar Time in hours. Printed on the other associated one ot the rotatable discs are parallel lines representative of sun angle and a perpendicularly arranged sun elevation line. Also printed on the other side of the disc member near its outer periphery is a set of indicia arcuately arranged and proportioned to scale the date of year relative to solar declination.

2 Claims, 4 Drawing Figures

SUN ANGLE CALCULATOR

ORIGIN OF THE INVENTION

The invention described herein was made in the performance of work under a NASA contract and is subject to the provisions of Section 305 of the National Aeronautics and Space Act of 1958, Public Law 85-568 (72 Statute 435; 42 U.S.C. 2456).

FIELD OF THE INVENTION

This invention relates to a calculator or computer and a system for determining the angle of the sun above the horizon for any given place and time on earth. More particularly, this invention relates to a hand operated, slide rule type of computer which can be used for quickly and easily determining sun angles relative to the horizon or time of sunset or sunrise.

BACKGROUND OF THE INVENTION

In earth-related space or aircraft flight operations, it is frequently necessary and desirable to determine the sun angle relative to the horizon at any given place and time on earth. For example, this is a necessary determination in planning for aerial photography. Heretofore, the sun angle could be calculated manually using celestial navigational methods and solar ephemeris data or by using a computer program. These methods are disadvantageous in the amount of reference data, time and equipment required to perform a sun angle calculation.

SUMMARY OF THE INVENTION

The present invention looks and operates similar to a circular slide rule. Printed on one side of a circular disc member are outer and inner circular sets of indicia respectively representative of site longitude and Greenwich Mean Time. The scales are interrelated so that the Greenwich Time at 00:00 and 24:00 is aligned with a 180° longitude representation and the time at 12:00 is aligned with a 0° longitude representation. Printed on an associated transparent disc which is rotatably mounted on the circular disc member is a circular set of indicia representative of Solar Time in hours. An indicator arrow extends radially from the pivot point through the 12:00 noon representation.

On the other side of the circular disc member are parallel lines representative of latitude between diametral representations of North and South poles. Elliptical lines extending between the representative North and South poles are proportionally disposed on the surface to scale Solar Time in hours. Printed on an associated, rotatably mounted transparent disc are parallel lines representative of sun angle and a sun elevation line which is perpendicular and bisecting the parallel lines. Also printed on said other side of the disc member is a set of indicia, arcuately arranged and proportional to scale the date of year relative to the Solar declination.

To determine the sun elevation or angle relation to the horizon, the arrow at 12:00 noon on the transparent disc is aligned with the Greenwich Mean Time value by rotating the transparent disc relative to the circular disc. Upon alignment of the solar and Greenwich Time values on the scales, from the longitude value, a corresponding Solar Time value is determined.

On the other side of the circular disc, the sun elevation line on the transparent disc is set on the date of the year indicia. The corresponding Solar Time value and latitude values are coordinated and the sun angle value can be read from the transparent disc.

DESCRIPTION OF THE PREFERRED EMBODIMENT

Figure 1:
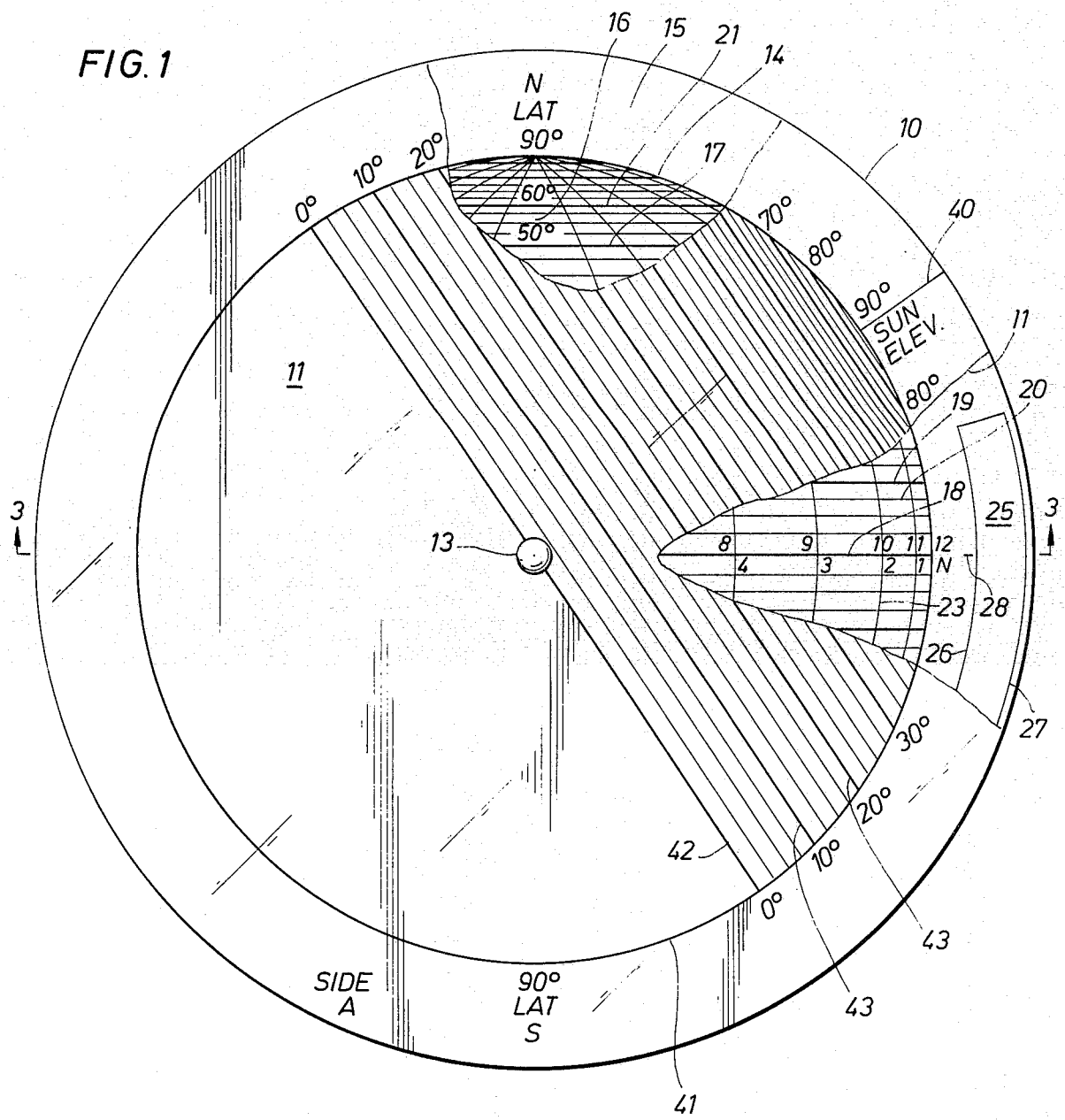
FIG. 1 illustrates in plan view one side of a circular disc and an associated transparent disc on which the latitude, sun elevation, solar time and date indicia are represented.
Figure 2:
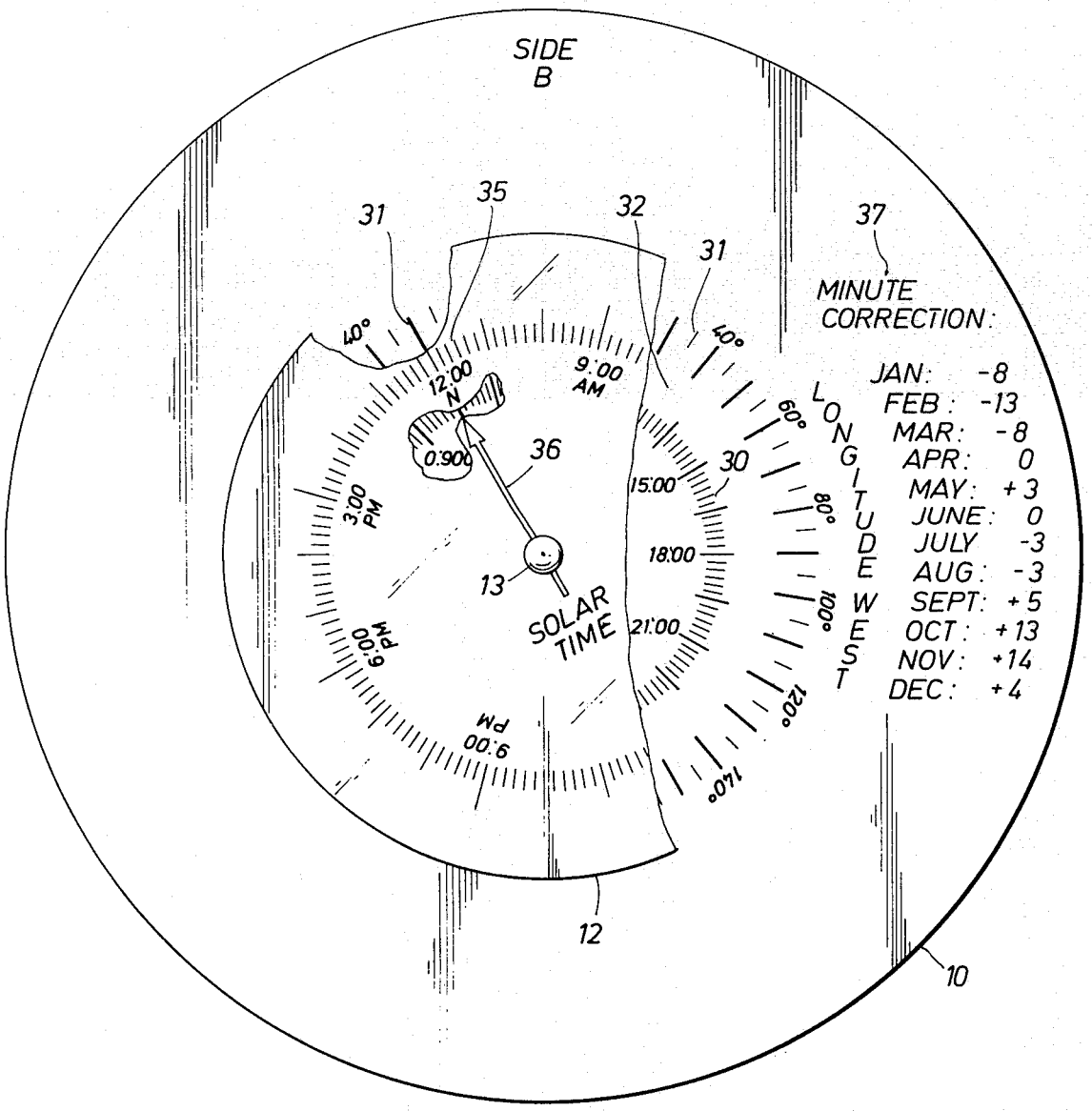
FIG. 2 illustrates in plan view the other side of the circular disc and an associated transparent disc on which solar time, Greenwich Mean Time and longitude are represented.
Figure 3:
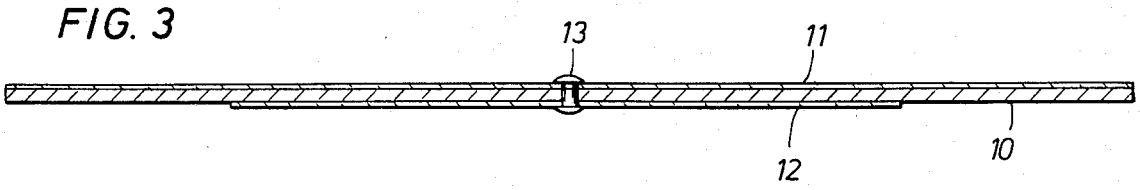
FIG. 3 is a view in cross-section taken along line 3—3 of FIG. 1.

Referring now to FIGS. 1 – 3, a thin and rigid plate member or disc member 10 is shaped as a circular disc and is about 10 inches in diameter. Thin, transparent, circularly shaped discs or plate members 11 and 12 are centrally located on both sides of the disc 10 and a pivot pin 13 is placed at the center. A disc or plate member 11, as shown in FIGS. 1 and 3 is sized substantially coextensive to the size or area of the base disc member 10. The plate member 12 has a lesser diameter than that of the disc member 10.

Referring now to FIG. 1, in particular, the disc member 10 has a set of indicia thereon which includes a printed circular line 14 which has a diameter about two inches less than the diameter of the disc member 10. Between the circular line 14 and the outer edge of the disc member 10 is an annular margin area 15 which extends about the periphery of the disc member 10. A vertical diameter line 16 for the circular line 14 is designated at its upper end with a letter "N" representing a North pole and is designated at its lower end with a letter "S" representing a South pole. Parallel lines 17 are disposed perpendicular to the line 16, sometimes hereafter referred to as the North-South line. The parallel lines 17 are spaced from one another to define vertical sections which represent equidistant latitude lines on a sphere. A horizontal diameter line 18 is perpendicular to the North-South line 16 and represents the equator. Parallel latitude lines are inscribed in a series of heavier printed lines 19 for each 10° of arc along a sphere from the equator line to the North and South poles. Between each of the lines 19 are lighter printed lines 20 which subdivide the 10° arc into smaller degree divisions of arc. As an illustration, line 21 represents 60° of latitude from the equator line 18.

Extending between the North "N" and South "S" poles are elliptical lines 23. The horizontal equator line 18 is designated at its right terminal end as "12N" representing noon Solar Time while at the left terminal end of the line 18 is a designation "12M" representing midnight. The elliptical lines 23 are spaced from one another in relation to solar time scales relative to latitude. The North-South line 16 in the set of lines 23 represents 6P.M. and 6A.M. The five lines 23 between the North-South line 16 and the ends of the equator line 18 represent A.M. and P.M. hours. The digits located above the line 18 designate A.M. hours while the digits located below the line 18 designate P.M. hours.

Figure 4:
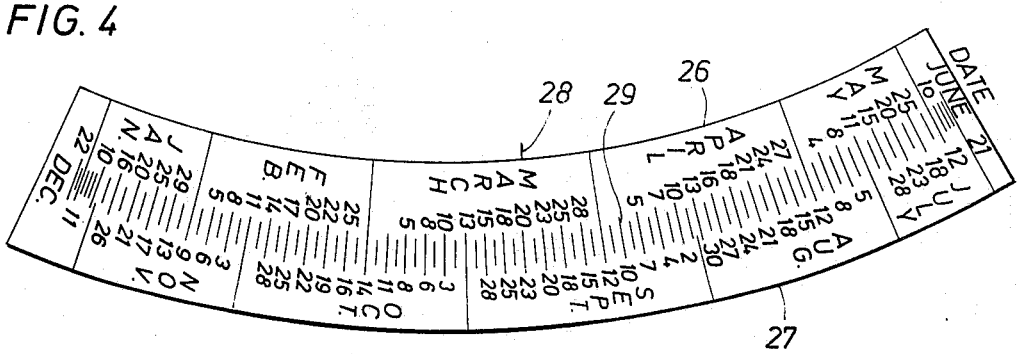
FIG. 4 is an inlayed view of the date scale illustrated on the disc of FIG. 1.

In the annular margin area 15 between the circular line 14 and the edge of the disc 10 is a date scale indicia 25. The date scale indicia 25 is inscribed within arcuate segment defined by inner and outer arc lines 26 and 27. The date scale indicia 25 consists of radial line markings for the days of the year in convenient incruments. The detail of the indicia 25 is illustrated in FIG. 4 and an index mark 28 is used to reference the location of the indicia relative to FIG. 1 and FIG. 4. The scale indicia 25 extends between the highest angle of solar declination of the year which occurs on June 21, and the lowest angle of solar declination of the year, which occurs on December 22. The index mark 28 is at the median date of March 20 and is located in radial alignment with the horizontal equator line 18. The date lines 29 are inscribed along radii relative to the pivot 13 and identified by month and day designations.

The superimposed transparent disc 11 is coupled to the disc member 10 by the pivot pin 13. On the transparent disc 11 is a printed circle 41 which is the same diameter as circular line 14 on the base disc member 10. A diametral line 42 extends through the pivot 13. Parallel lines 43 having spacings similar to the lines 19 on the disc 10 provide division of the semi-circular area into degrees between 0° and 90° similar to the latitude lines. The lines 43 represent sun angle values. A perpendicular line 40 is on the disc 11 in the margin between the circle 41 and the outer perimeter of the disc 11 and extends radially of the center pivot 13. The perpendicular line 40 if extended to the pivot 13 would bisect the lines 43.

Referring now to FIG. 2, on the surface of the other side of the disc 10 is a first set 30 of indicia which is circularly arranged about the pivot 13 and indicates Greenwich Mean Time. The time marker indicia radially inscribed lines. A 00:00 time value is located at a 6:00 o'clock position and clockwise goes to 24:00 hours. A second set 31 of indicia is circularly arranged about the pivot 13 at a location radially outward from the indicia set 30 so as to leave an annular margin or space 32 therebetween. The indicia set 31 is representative of longitude between 0° and 180° . The 0° position is at 12:00 o'clock position and in clockwise direction, longitudes west are designated between 0° and 180° and, in a counter-clockwise direction, longitudes east are designated between 0° and 180°. The superimposed transparent disc 12 has a set 35 of indicia which depict 24 solar hours in a circularly arranged location to overlie the annular space 32 on the disc 10. The time marker indicia are radially inscribed lines, radial to the center of the discs. An arrow 36 is printed on the disc 12 to extend radially from the pivot 13 in a line with the 12:00 noon designation and with the arrow tip arranged to overlie the indicia set 30.

For increased accuracy, a minute correction chart (Solar Time equation) 37 as illustrated in FIG. 2, is printed on the disc 10 indicating the time corrections which can be applied for each month.

In the operation and performance of the method for determining the sun angle relative to horizon by the present invention, the operator begins by determining the Solar Time relative to Greenwich Mean Time and to longitude. This is accomplished by setting the arrow 36 of the transparent disc 12 to the then existing Greenwich Mean Time value on the indicia set 30. From the longitude value on the indicia set 31 for the instant position of the observer, a Solar Time value is obtained from the indicia set 35. The determined Solar Time value is adjusted according to the values of chart 37. Next, the adjusted Solar Time value is correlated relative to the calendar day and latitude. This is accomplished by setting the radial sun elevation line 40 on the disc 11 on the date in the indicia set 25. From this position of the discs 10 and 11, the adjusted Solar Time value is located on line 18 and translated to a location representing the instant latitude of the observer. At the point of the instant latitude, the value represented by the parallel lines 43 is the sun elevation angle value.

While particular embodiments of the present invention have been shown and described, it is apparent that changes and modifications may be made without departing from this invention in its broader aspects; and therefore, the aim in the appended claims is to cover all such changes and modifications as fall within the true spirit and scope of this invention.

What is claimed is:

1. Apparatus for determining the angle of sun elevation for a particular geographical location at a given time and date, said apparatus comprising:

a circularly shaped base member having a central axis, said base member having on one side thereof a first set of indicia in the form of parallel lines arranged within a circular area for representation of latitudes between locations in said circular area representative of North and South poles of the earth, a second set of indicia on said base member which are in the form of elliptical curve lines extending as meridians between said North and South pole locations and arranged for representation of Solar Time values;

a transparent plate superposed on said base member and mounted for rotation about said central axis, said transparent plate having a third set of indicia in the form of parallel lines on one-half of said plate arranged as lines of latitude for representation of sun angle, said first and third sets of parallel line indicia being proportioned in degrees of latitude and being capable of a matching overlay in one position of said transparent plate member relative to said base member;

a perpendicular sun elevation line inscribed on said transparent plate extending radially of said central axis and perpendicular to the parallel lines of said third set of indicia in a position which would bisect said third set of indicia, and a fourth set of date scale indicia arcuately disposed to either side of the equator line of said first set of latitudes indicia, said fourth set of indicia being scaled relative to said central axis to represent solar declination for the days of the year; and whereby said transparent plate may be oriented with the radial sun elevation line coincident with an indicium representing said given date in the date scale indicia to compensate for solar declination and thereby indicate the sun angle for said geographical location as indicated by the location relative to said sun angle indicia of the intersection point of the elliptical curve line corresponding to solar time at the geographical location with the line representing latitude of said geographical location.

2. The apparatus as defined in claim 1 and further including on the other side of said base member:

a fifth set of radial indicia on said base member, said fifth set of indicia being circularly disposed at a first diametrical distance from said central axis and displaying angular degrees from 0° to 180° in an obverse relationship to represent longitudes west and east of the Greenwich meridian;

a sixth set of indicia on said base member, said sixth set of indicia being circularly disposed at a second diametrical distance from said central axis and in a clock face arrangement to display time for twenty-four hours with the 24-hour indicium in co-radial alignment with the 0° longitude indicium of said fifth set whereby said sixth set of indicia are representative of Greenwich meridian time; and a second transparent plate mounted on said base member for rotation about said central axis, said second transparent plate having a seventh set of radial indicia circularly disposed at a third diametrical distance from said central axis and displaying Solar Time for one day with an indicia marking for twelve o'clock noon whereby said second transparent plate may be oriented with the twelve o'clock indicia marking in co-radial alignment with the indicium of said sixth set which represents Greenwich meridian time for said geographical location to thereby obtain an indication of local solar time as provided by the co-radial alignment of the longitude indicium for said location with the solar time indicium indicating local solar time for derivation of the sun angle for the geographical location.

* * * * *